US007562409B2

(12) United States Patent
Chan

(10) Patent No.: US 7,562,409 B2
(45) Date of Patent: Jul. 21, 2009

(54) ADJUSTING STRUCTURE FOR ADJUSTING THE RISE AND FALL OF A MATTRESS BY AIR SPRING

(76) Inventor: Jui-Peng Chan, No. 135, Sec. 3, Jhongshan Rd., Changhua City, Changhua County 50075 (TW)

( * ) Notice: Subject to any disclaimer, the term of this patent is extended or adjusted under 35 U.S.C. 154(b) by 102 days.

(21) Appl. No.: 11/829,933

(22) Filed: Jul. 29, 2007

(65) Prior Publication Data

US 2009/0025149 A1 Jan. 29, 2009

(51) Int. Cl.
*A47C 21/06* (2006.01)
*A47C 20/04* (2006.01)

(52) U.S. Cl. ..... 5/660; 5/615

(58) Field of Classification Search ..... 5/660, 5/659, 658, 634, 633, 630, 615, 710, 713, 5/715, 118, 644, 654, 655.3; 267/117
See application file for complete search history.

(56) References Cited

U.S. PATENT DOCUMENTS 1,353,260 A * 9/1920 Monks ..... 5/659
2,150,747 A * 3/1939 Naulty ..... 267/145
2,239,300 A * 4/1941 O'Dell et al. ..... 267/117
2,434,641 A * 1/1948 Burns ..... 267/117
3,299,447 A * 1/1967 Dome ..... 5/118
3,371,359 A * 3/1968 Dome ..... 5/118
3,667,075 A * 6/1972 Ballard et al. ..... 5/722
3,717,885 A * 2/1973 De Mare ..... 5/607
3,781,928 A * 1/1974 Swallert ..... 5/660
4,127,906 A * 12/1978 Zur ..... 5/615
4,144,601 A * 3/1979 Anderson et al. ..... 5/118
4,188,677 A * 2/1980 Zur ..... 5/615
4,196,483 A * 4/1980 Lefler et al. ..... 5/118
4,309,783 A * 1/1982 Cammack et al. ..... 5/660
4,497,078 A * 2/1985 Vogel et al. ..... 5/118
4,527,298 A * 7/1985 Moulton ..... 5/615
4,669,139 A * 6/1987 Richter, Jr. ..... 5/118
4,697,290 A * 10/1987 Alklind et al. ..... 5/632
4,807,313 A * 2/1989 Ryder et al. ..... 5/610
4,839,932 A * 6/1989 Williamson ..... 5/615
4,873,731 A * 10/1989 Williamson ..... 5/615
4,979,248 A * 12/1990 Kelley ..... 5/118
4,989,281 A * 2/1991 Christensen ..... 5/118
5,170,522 A * 12/1992 Walker ..... 5/615
5,218,728 A * 6/1993 Lloyd et al. ..... 5/118
5,257,430 A * 11/1993 Yamaguchi ..... 5/659
5,313,679 A * 5/1994 Yamaguchi ..... 5/659

(Continued)

FOREIGN PATENT DOCUMENTS

EP 557665 A1 * 9/1993

(Continued)

*Primary Examiner*—Robert G Santos
(74) *Attorney, Agent, or Firm*—Banger Shia

(57) ABSTRACT

An adjusting structure for adjusting the rise and fall of a mattress by air spring, comprises a plurality of air springs and a control device. The air springs are located under the mattress, and the control device controls the amount of air in the respective air springs so as to control their extension and retraction, thus adjusting the rise and fall of the mattress and producing a massage effect. Further, according to different figures of different users, the mattress can be adjusted to a most appropriate sleeping posture for the users.

4 Claims, 6 Drawing Sheets

U.S. PATENT DOCUMENTS

| | | | | |
|---|---|---|---|---|
| 5,598,591 | A * | 2/1997 | Kelley | 5/118 |
| 5,806,115 | A * | 9/1998 | Brown | 5/615 |
| 6,012,186 | A * | 1/2000 | Soltani et al. | 5/614 |
| 6,189,168 | B1 * | 2/2001 | Graebe | 5/644 |
| 6,415,467 | B1 * | 7/2002 | Bretvin | 5/710 |
| 6,510,573 | B1 * | 1/2003 | Grabe | 5/644 |
| 6,671,900 | B2 * | 1/2004 | Davis | 5/118 |
| 6,715,171 | B2 * | 4/2004 | Grabe | 5/644 |
| 6,715,172 | B2 * | 4/2004 | Leventhal et al. | 5/660 |
| 6,718,574 | B1 * | 4/2004 | Bradley et al. | 5/118 |
| 6,739,005 | B2 * | 5/2004 | Davis | 5/615 |
| 6,772,462 | B1 * | 8/2004 | Harrell | 5/660 |
| 6,971,127 | B2 * | 12/2005 | Richards | 5/108 |
| 6,993,798 | B1 * | 2/2006 | Roberts | 5/118 |
| 2002/0100116 | A1 * | 8/2002 | Richards | 5/108 |
| 2003/0110565 | A1 * | 6/2003 | Grabe | 5/644 |
| 2003/0188387 | A1 * | 10/2003 | Leventhal et al. | 5/660 |
| 2009/0025149 | A1 * | 1/2009 | Chan | 5/660 |

FOREIGN PATENT DOCUMENTS

EP 568465 A1 * 11/1993

* cited by examiner

ADJUSTING STRUCTURE FOR ADJUSTING THE RISE AND FALL OF A MATTRESS BY AIR SPRING

BACKGROUND OF THE INVENTION

1. Field of the Invention

The present invention relates to an adjusting structure for adjusting the rise and fall of a mattress, and more particularly an adjusting structure for adjusting the rise and fall of a mattress by air spring.

2. Description of the Prior Art

A person sleeps at least six hours a day, that is to say that a large part of a person's life is spent in bed. Therefore, it is very important to make people feel comfortable in this large part of his life. However, different people have different sleep habit, finding a bed suitable for yourself seems easy but it is not.

The existing mattress is designed to change its shape to fit the user's figure, so if the user's sleeping posture is not correct, it cannot be detected and corrected. However, it will be good to improve the sleeping posture if the mattress can change its shape after the user lies on it to make the user adjust his sleeping posture to fit the shape of the mattress.

The present invention has arisen to mitigate and/or obviate the afore-described disadvantages.

SUMMARY OF THE INVENTION

The primary objective of the present invention is to provide an adjusting structure for adjusting the rise and fall of a mattress by air spring, which uses a control device to adjust the amount of air in the respective air springs so as to control their extension and retraction. And these air springs are disposed under the mattress so as to make it easy to adjust the rise and fall of the mattress.

The adjusting structure for adjusting the rise and fall of a mattress by air spring in accordance with the present invention, comprises a plurality of air springs and a control device. The air springs are located under the mattress and connected to the pipe of the control device, and the control device controls the amount of air in the respective air springs so as to control their extension and retraction, thus adjusting the rise and fall of the mattress.

When the user lies on the mattress, the control device makes the air springs extend or retract so as to change the rise and fall of the mattress, which can not only massage the user but also the extension and retraction of the air springs can be adjusted based on the user's figure so as to adjust the shape of the mattress to fit the user's figure, making it easier for the user to sleep. Further, after the user is asleep, the rise and fall of the mattress can be adjusted again to correct the sleeping posture of the user, so that the user can sleep in a correct posture, and the sleeping posture can be corrected imperceptibly.

In addition, some of the air springs are provided with support structures. Each support structure includes a bearing board disposed on the top of the air springs. And the rest of the air springs without support structures are disposed on the support structures to support the mattress, thus achieving an effect of adjusting the rise and fall of the mattress in a two-stage manner.

And a pillow portion is arranged on the mattress, under the pillow portion is a plurality of air springs which is connected to the control device via air pipes. The control device controls the extension and retraction of the air springs so as to control the rise and fall of the pillow portion.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Referring to FIGS. 1-6, an adjusting structure for adjusting the rise and fall of a mattress by air spring comprises: a plurality of air springs 10*a*, 10*b* and a control device 20.

The plurality of air springs 10*a* and 10 is disposed beneath the mattress A. Each of the air springs 10*a* and 10 is provided at the bottom thereof with an air pipe 10*c* that extends outwards and is in communication with the interior of the respective air springs 10*a* and 10. Each of air springs 10*a* is provided with a support structure 11 which includes a bearing board 12 located at the top of the air springs 10*a*. And the air springs 10*b* without the support structure 11 are disposed on the bearing boards 12 to support the mattress A.

The control device 20 is connected to the air pipes 10*c* of the respective air springs 10*a*, 10*b* for adjusting the amount of air in the respective air springs 10*a*, 10*b*.

Figure 1:
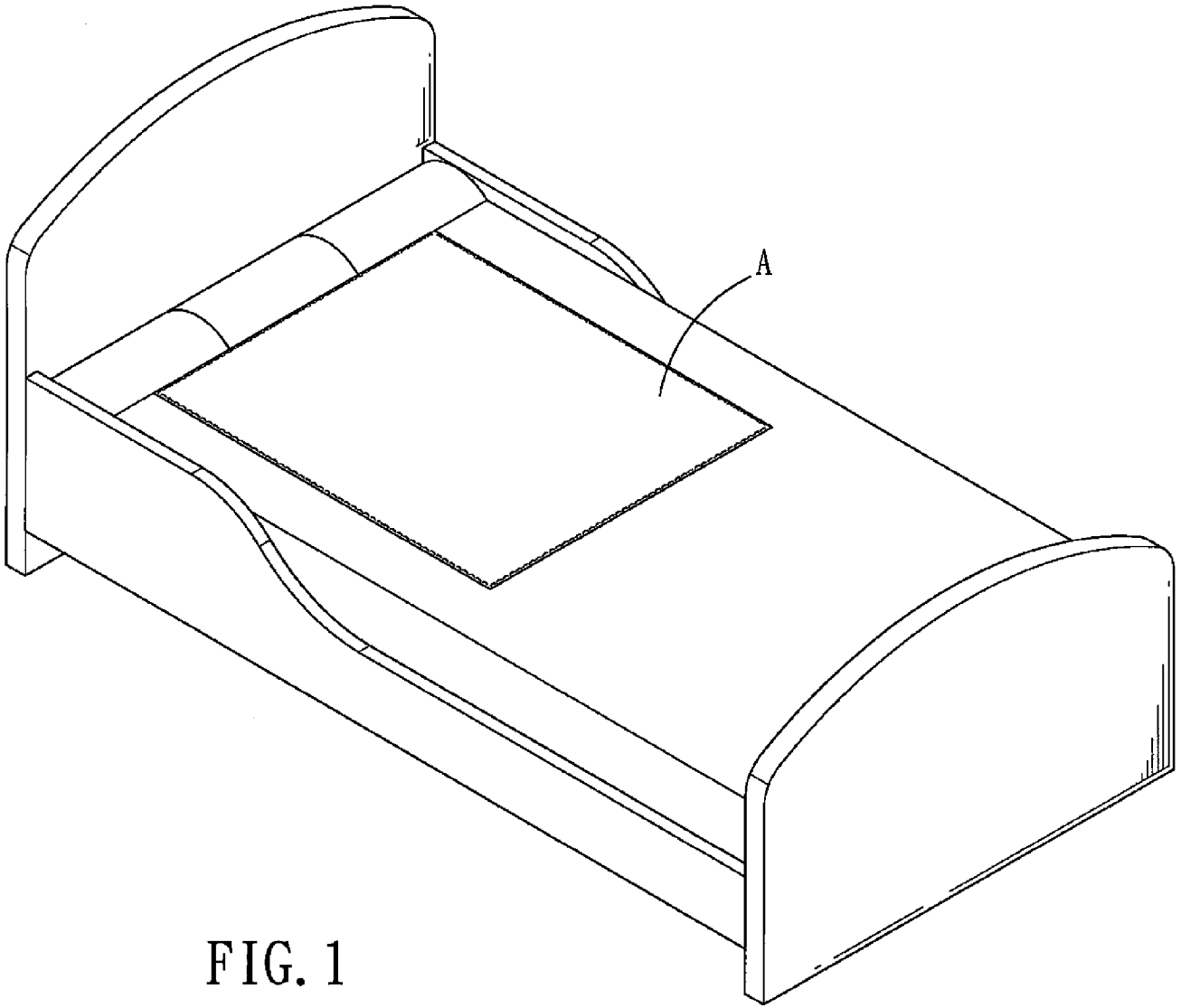
FIG. 1 is a perspective view in accordance with the present invention of showing a bed with a mattress.
Figure 2:
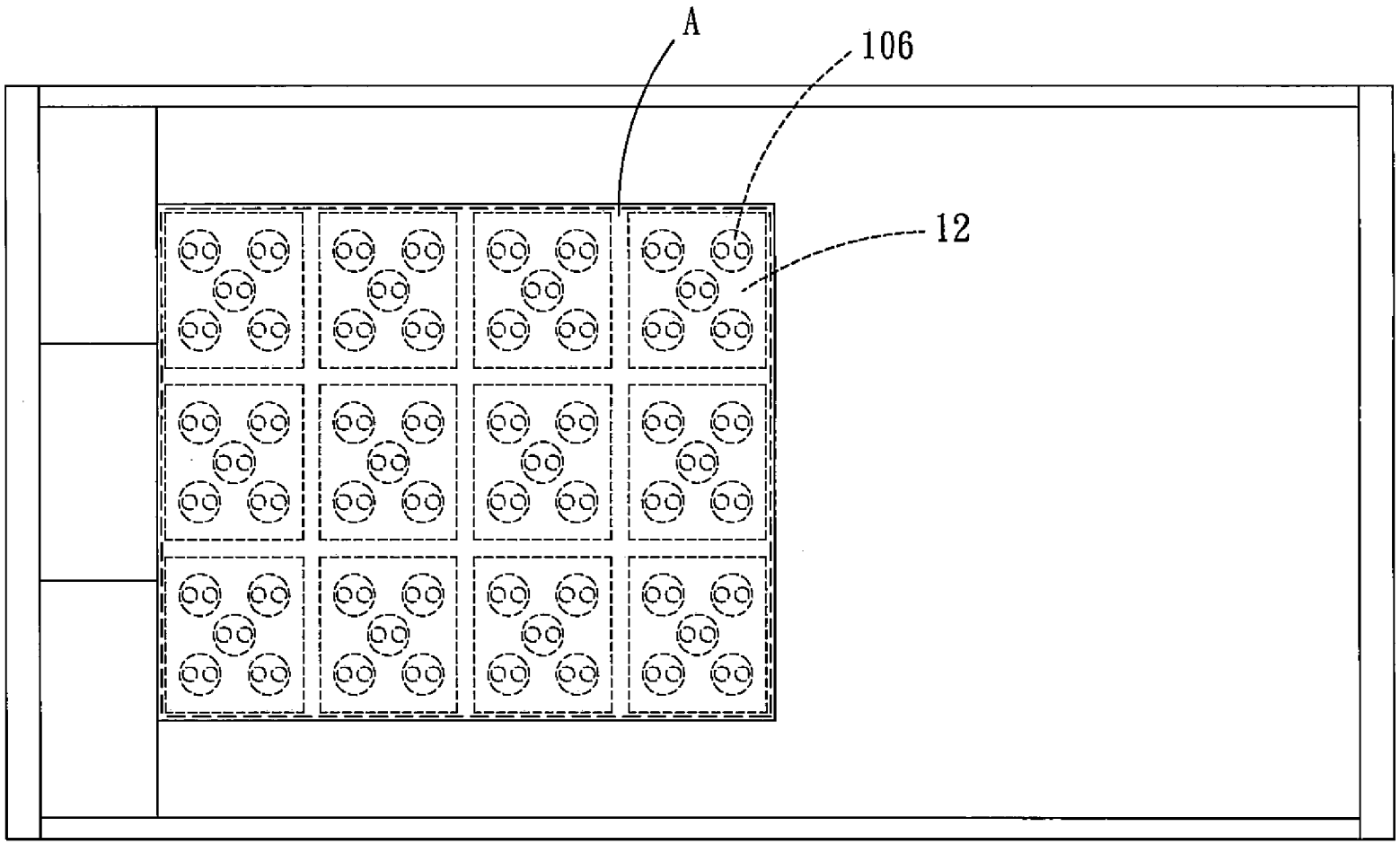
FIG. 2 is a perspective view in accordance with the present invention of showing that adjusting structure is disposed under the mattress for adjusting the rise and fall of the mattress by air spring.
Figure 3:
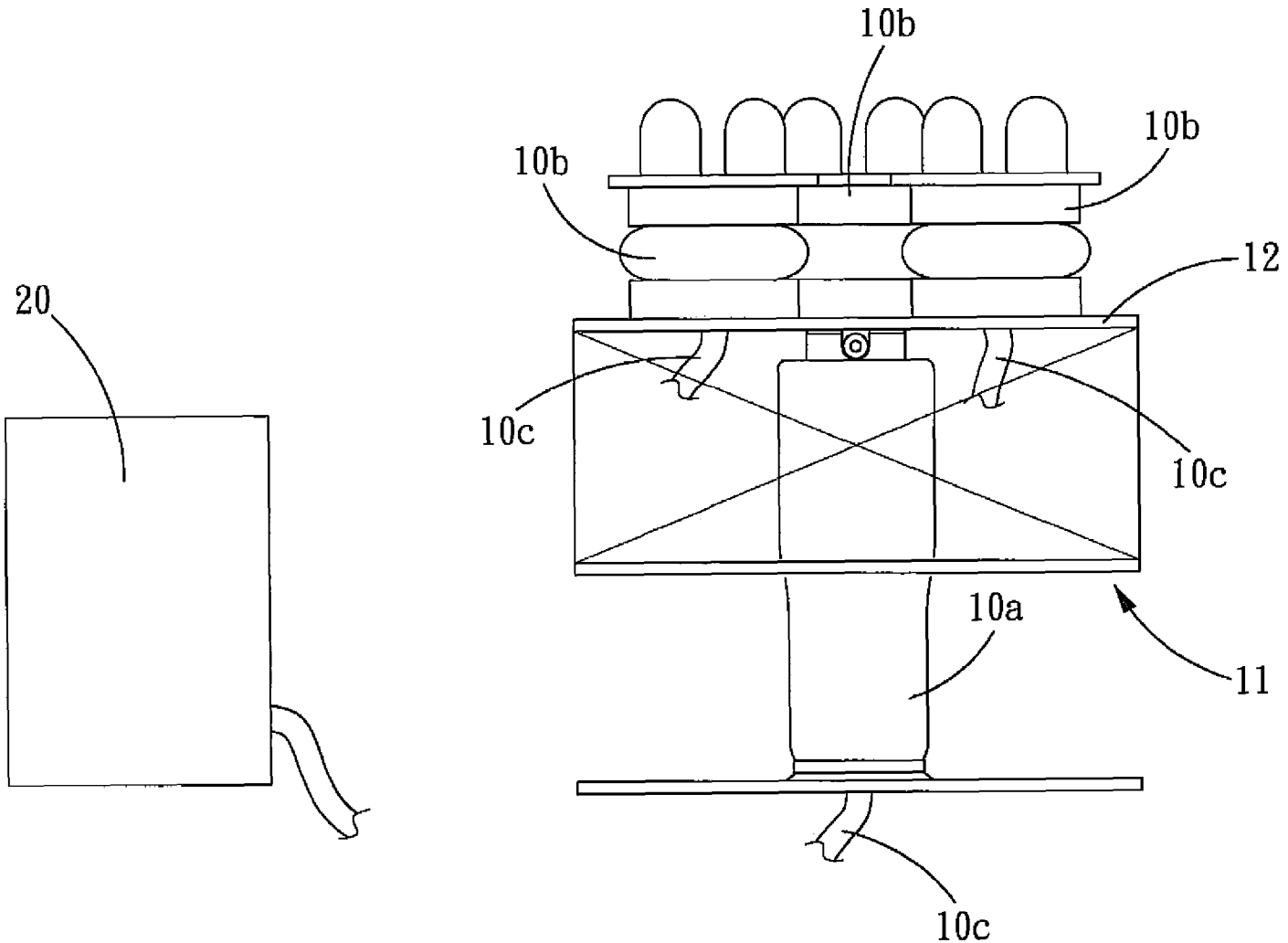
FIG. 3 is a perspective view of the adjusting structure for adjusting the rise and fall of a mattress by air spring in accordance with the present invention.
Figure 4:
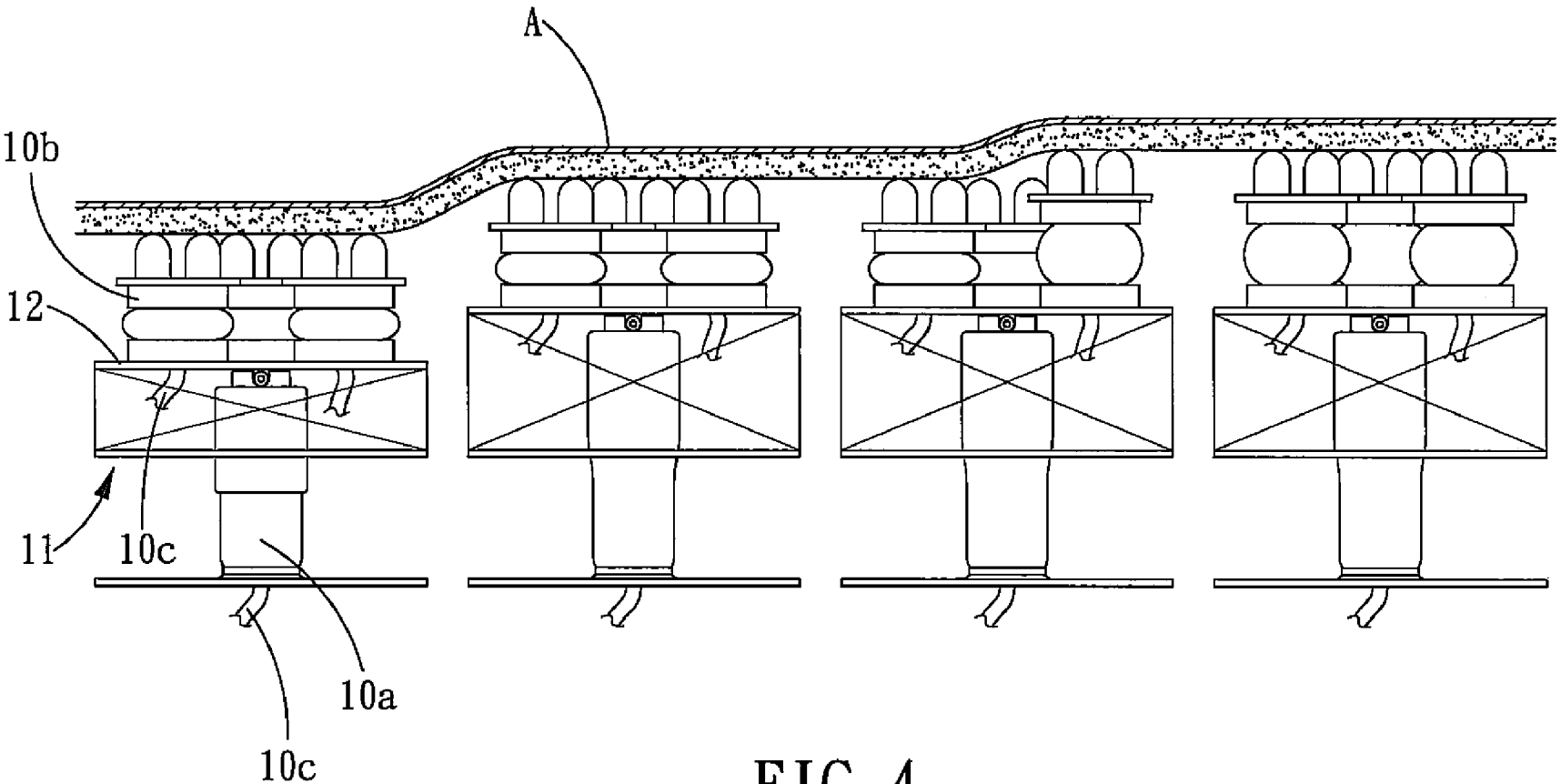
FIG. 4 is an operational view in accordance with the present invention of showing that the adjusting structure is adjusting the rise and fall of the mattress by air spring.

The adjusting structure for adjusting the rise and fall of a mattress of the present invention, as shown in FIG. 4, utilizes the control device 20 to adjust the amount of air in the respective air springs 10*a*, 10*b* so as to control their extension and retraction, so that the air springs 10*a* with the support structures 11 can control the rise and fall of the air springs 10*b* on the bearing board 12 of the support structures 11, and the air springs 10*b* on the support structures 11 can use its extension and retraction to control the rise and fall of the mattress A, thus achieving an effect of adjusting the rise and fall of the mattress A in a two-stage manner.

Figure 5:
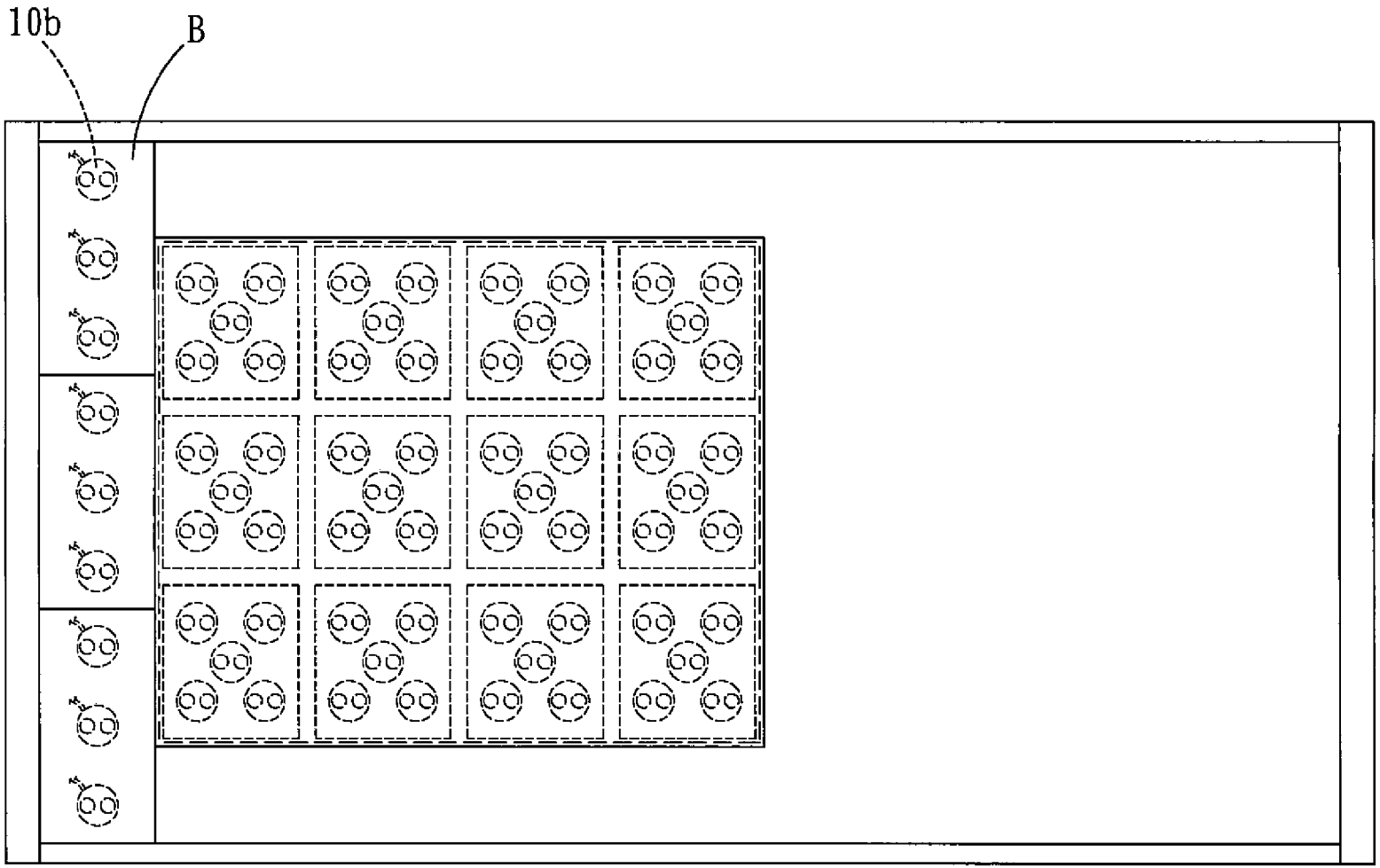
FIG. 5 shows that the mattress is defined with a pillow portion.
Figure 6:
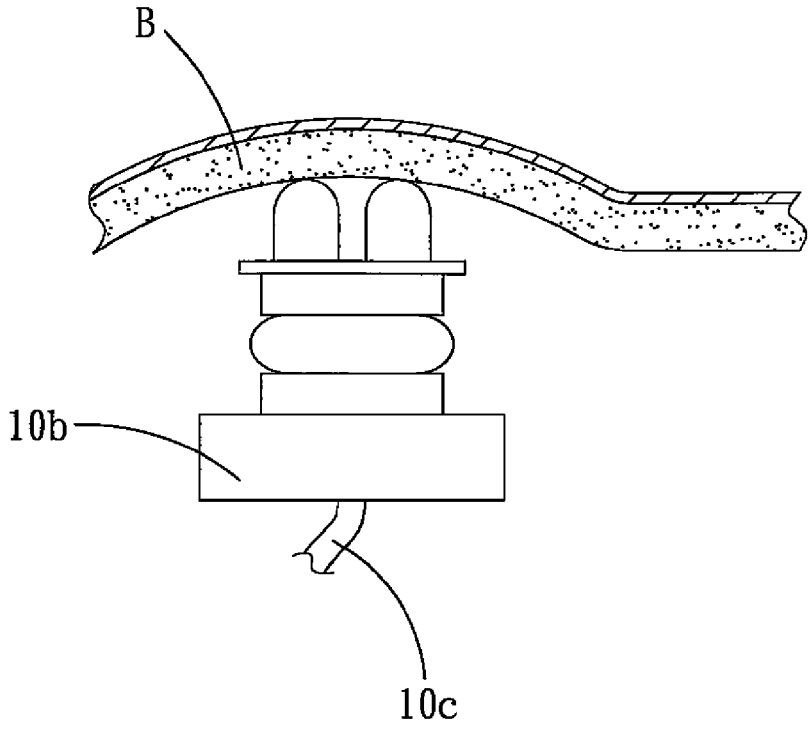
FIG. 6 shows that the adjusting structure of the present invention is disposed under the pillow portion of the mattress.

In addition, as shown in FIGS. 5 and 6, a pillow portion B is arranged on the mattress A, under the pillow portion B is a plurality of air springs 10*b* which is connected to the control device 20 via air pipes 10*c*. The control device 20 controls the extension and retraction of the air springs 10*b* so as to control the rise and fall of the pillow portion B.

When the user lies on the mattress A, the control device 20 makes the air springs 10*a*, 10*b* extend or retract so as to change the rise and fall of the mattress A, which can not only massage the user but also the extension and retraction of the air springs 10*a*, 10*b* can be adjusted based on the user's figure so as to adjust the shape of the mattress A to fit the user's figure, making it easier for the user to sleep.

Further, for some users with incorrect standing posture or scoliosis, after they are asleep, the rise and fall of the mattress A can be adjusted again to correct the sleeping posture of the users, so that the users can sleep in a correct posture, and the sleeping posture can be corrected imperceptibly.

After the mattress A is provided with a pillow portion B, the air springs 10*b* under the pillow portion B can also adjust the rise and fall of the pillow portion B, so as to make the user sleep more comfortably.

To summarize, the adjusting structure for adjusting the rise and fall of a mattress by air spring in accordance with the present invention, comprises a plurality of air springs and a control device. The air springs are located under the mattress, and the control device controls the amount of air in the respective air springs so as to control their extension and retraction, thus adjusting the rise and fall of the mattress and producing a massage effect. The air springs are controlled by the control device separately to control the whole or a part of the mattress to rise and fall. Further, according to different figures of different users, the mattress can be adjusted to a most appropriate sleeping posture for the users.

While we have shown and described various embodiments in accordance with the present invention, it is clear to those skilled in the art that further embodiments may be made without departing from the scope of the present invention.

What is claimed is:

1. An adjusting structure for adjusting the rise and fall of a mattress, comprising:

a plurality of air springs disposed under a mattress, some of the air springs being provided with support structures, and the rest of the air springs without support structures being disposed on the support structures to support the mattress; and a control device being connected to the respective air springs via air pipes and used to control the extension and retraction of the air springs and adjusting the rise and fall of the mattress by controlling the amount of air in the respective air springs;

wherein each of the support structures includes a bearing board located at the top of the air springs which are provided with the support structures, the air springs without the support structures are located on top of the bearing boards, the air springs are controlled by the control device separately to control the whole or a part of the mattress to rise and fall in a two-stage manner.

2. The adjusting structure for adjusting the rise and fall of a mattress as claimed in claim 1, wherein a pillow portion is arranged on the mattress, and the plurality of air springs is arranged under the pillow portion and connected to the control device via the air pipes.

3. The adjusting structure for adjusting the rise and fall of a mattress as claimed in claim 1, wherein each of the air springs is provided at a bottom thereof with an air pipe that extends outwards and is in communication with the interior of the respective air springs.

4. The adjusting structure for adjusting the rise and fall of a mattress as claimed in claim 2, wherein each of the air springs is provided at a bottom thereof with an air pipe that extends outwards and is in communication with the interior of the respective air springs.

* * * * *